United States Patent [19]

Reed

[11] Patent Number: 4,892,623

[45] Date of Patent: Jan. 9, 1990

[54] TWO-SPEED STEPPER ACTUATOR

[75] Inventor: Gordon K. Reed, Bexley, Ohio

[73] Assignee: Process Automation Business, Inc., Columbus, Ohio

[21] Appl. No.: 311,915

[22] Filed: Feb. 17, 1989

[51] Int. Cl.[4] ..... D21F 1/02

[52] U.S. Cl. ..... 162/344; 74/128; 74/142; 162/259; 162/336; 192/41 R; 192/80

[58] Field of Search ..... 162/259, 344, 336; 74/128, 142; 192/41 R, 80; 222/57, 333

[56] References Cited

U.S. PATENT DOCUMENTS

| | | | |
|---|---|---|---|
| 4,517,055 | 5/1985 | Dove | 162/347 |
| 4,526,654 | 7/1985 | Johansson et al. | 162/259 |
| 4,719,816 | 1/1988 | Carlnäs | 74/625 |
| 4,726,883 | 2/1988 | Schroeder | 162/344 |

FOREIGN PATENT DOCUMENTS

| | | | |
|---|---|---|---|
| 3535849 | 4/1987 | Fed. Rep. of Germany | 162/344 |

OTHER PUBLICATIONS

MICROSET ® Actuator Family . . . Microset Linear Stepper Slice Actuators © 1987 Accuray Corporation (A Sub. of Combustion Engineering, Inc.).

*Primary Examiner*—Karen M. Hastings
*Attorney, Agent, or Firm*—John H. Mulholland

[57] ABSTRACT

A two-speed stepper actuator unit for use in paper machine headbox slice lip control has a spindle 16 driven by a power nut 24. A lever clamp 32 has legs 34 and 36 selectively clamped together around nut 24 by means of a cam action locking plate 40 driven by solenoid 48. The longer leg 36 of clamp 32 has a cam follower which rotationally drives nut 24 through the lever 36 in response to the shape of a cam plate 50 which translates in the housing 12 on antifriction rollers 66 when drive solenoid 54 is actuated. The cam surface 60 guides the lever 36 in either of two speed modes depending on whether spring biased roller follower 52 is on cams surface portion 62 or 64.

13 Claims, 4 Drawing Sheets

TWO-SPEED STEPPER ACTUATOR

BACKGROUND OF THE INVENTION

1. TECHNICAL FIELD

This invention relates to a two-speed stepper actuator for rotationally driving a member such as a paper machine headbox slice opening control spindle. The driven spindle is one of a plurality that are evenly distributed across the width of the slice for acting on the control lip of the slice. More particularly, the invention relates to a stepper actuator for rotationally driving the spindles individually in ratchet-like fashion at two speeds, one for "macromotion" of, perhaps, 16 micron of slice lip travel and another for "micromotion" of, perhaps 1 micron of slice lip travel.

2. BACKGROUND ART

The slice opening of a headbox on a paper machine meters flow of the pulp slurry or stock in the headbox onto the fourdrinier wire. A number of rotationally driven spindles, perhaps 50 to 60, are connected to a headbox control lip to vary the metering opening transversely across the machine. The spindles typically are threadedly attached at their upper ends to rotationally driven power nuts which linearly drive the individual spindles in known manner. The two speed stepper actuator of the invention drives the power nuts in a ratchet-like rotational fashion to accomplish the linear spindle motion at either of two speeds.

The rotationally driven power nuts have largely replaced manually adjusted spindles or jack screws on paper machines because they provide for increased linear sensitivity for slice lip adjustment purposes. It has been known to equip each spindle or jackscrew with a separate driving motor and gear reducer. The advantage of being able to power the spindle at a macromotion rate and then to finely adjust the slice lip opening by means of micromotion has not heretofore been available in a stepper actuator. The present invention thus provides a needed device for fast and accurate control of the slice lip of a headbox.

SUMMARY OF THE INVENTION

The two-speed stepper actuator of the invention for use to control the slice lip of a headbox on a paper machine provides ratchet-like rotational drive of a power nut clamped to the end of the slice lip control spindle. The stepper actuator provides good speed of response at two speeds which enables good positional accuracy. It permits the production of control quality paper by basis weight profiles through the elimination of cross-machine variations.

The two speed stepper actuator of the invention includes a clamp for engagement with the power nut clamped to the spindle. The clamp has opposed clamping legs in spaced substantially parallel relation to engage the outer periphery of the power nut member to be rotationally driven. The legs extend transversely to the axis of rotation of the power nut and are of different length. A means for moving the legs toward each other to clamp the power nut periphery is a locking cam plate with an inner opening which includes a cam surface having surfaces tapered toward each other engaging the outer surfaces of the legs to move the legs toward each other. A solenoid moves the locking plate transverse to the legs and downwardly until the clamp is locked with the power nut clamped by the legs.

The longer leg of the clamp includes a cam follower on its end for engagement with an internal cam surface of another cam plate which provides measured rotational movement upon its transverse movement in response to actuation of a different solenoid. This is accomplished by movement of the follower, under bias of a spring, against a cam surface defining opening in the cam plate during the solenoid induced transverse motion. The opening has a portion of the cam surface for movement of the spring biased follower one transverse distance, for instance 16 microns, when the cam plate moves a portion of its transverse motion and a different portion of the cam surface for movement of the spring biased follower a second transverse distance, for instance, 1 micron, when the cam plate moves a different portion of the distance of its transverse motion, thereby providing different rotation amounts and speeds to the power nut, upon movement of the cam means different transverse distances when said power nut means is clamped. The cam plates may be provided with suitable ball bearinged anti-friction tracks in which to translate.

DESCRIPTION OF THE PREFERRED EMBODIMENTS

Figure 1:
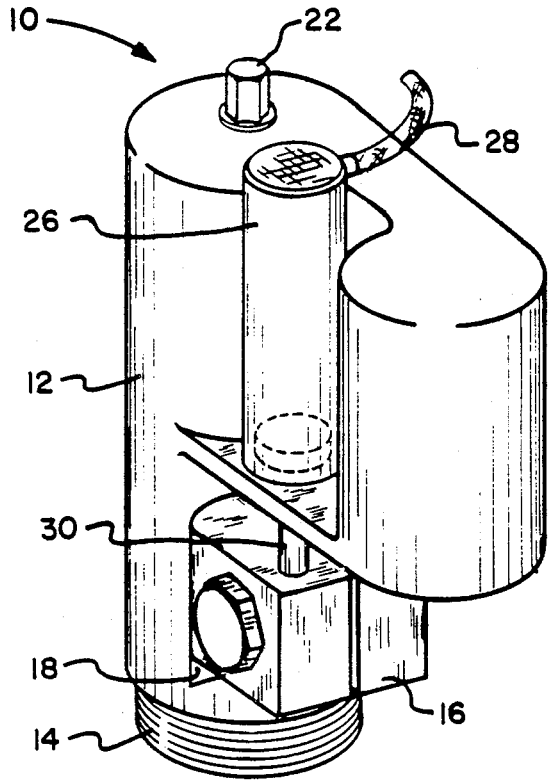
FIG. 1 is a perspective view of a possible form the two speed stepped actuator, power nut and clamped spindle combination of the invention.

The numeral 10 generally designates the assembled two-speed stepped actuator, power nut and clamped spindle combination of the invention. As seen in FIG. 1, the combination or unit may include a cover or housing 12 having threads 14 which attach the device to a base plate on the outside of a paper machine headbox. A spindle clamp 16 projects out of and through an opening 18 in the housing which fixes it in a manner which prevents rotating of the clamp and the slice lip control spindle 20 (FIG. 2) to which it will be attached. A hexagonal manual adjustment shaft 22 connected to spindle 20 through the power nut 24 extends through the top of housing 12. A linear variable differential transducer (LVDT) 26 is appropriately provided and electrically connected by cable 28 to the control circuitry. The LVDT probe engages clamp 16 to sense position of the spindle 20 attached thereto and to signal the control circuit through cable 28 accordingly.

Figure 2:
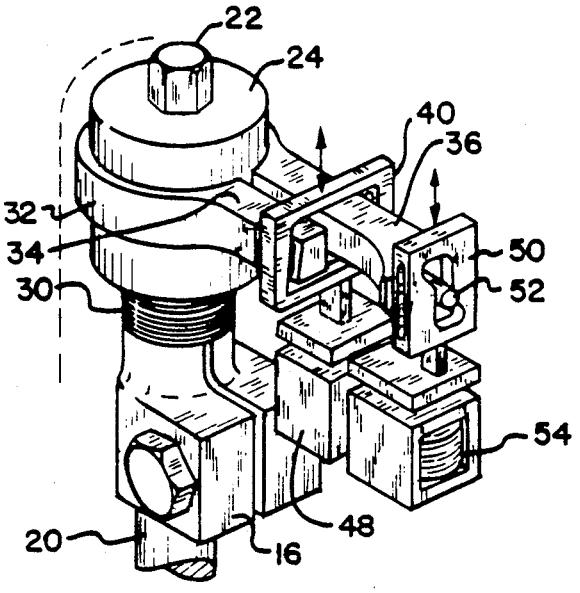
FIG. 2 is a somewhat schematic perspective view of the combination of FIG. 1 with the outside cover and bearings removed for clarity.

In FIG. 2, where the housing 12 is removed from the unit, the size and shape of the parts are schematically shown and may be somewhat distorted and out of scale. The power nut 24 rides in the housing 12 in bearings not shown for clarity but well understood in the art. It is only necessary to understand that rotation of power nut 24 causes the linear driving of spindle 20 through non-rotating clamp 16 and its integral threads 30.

Surrounding the power nut 24 and in engagement therewith is a lever clamp 32 having opposed clamping legs 34 and 36 in spaced substantially parallel relation. The legs 34 and 36 are of different length and both extend transversely to the axis of rotation of power nut 24. Locking means 40 are provided for moving the legs 34 and 36 toward each other to clamp the periphery of power nut 24, the member to be rotationally driven. The locking means 40 is a locking plate or cam plate with an open central portion defining cam surfaces 42 and 44 which converge toward each other and engage respectively the legs 34 and 36 to move them toward each other. A clamp solenoid 48 is mounted to leg 36 of lever clamp 32 to downwardly and transversely to the legs 34 and 36, from the position shown in FIG. 3 to the position shown in FIG. 4, until the clamp is locked with the power nut 24 locked to the clamp 32. Antifriction means 46 can be provided in tracks between leg 34 and cam surface 42 and leg 36 and cam surface 44.

Figure 3:
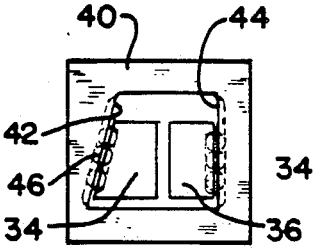
FIG. 3 is a schematic front view of the locking cam plate of the combination of FIGS. 1 and 2 in the unlocked position.
Figure 4:
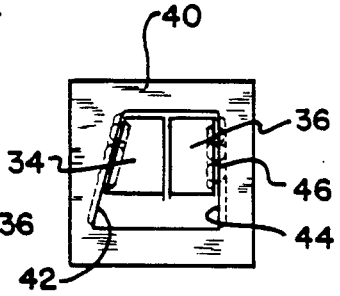
FIG. 4 is a view similar to FIG. 3 with the legs in locked and clamping position.

The cam plate 40 is moved from the position shown in FIG. 3 to the position shown in FIG. 4 and back by means of a clamp solenoid 48 mounted on longer leg 36 for movement therewith. The solenoid 48 is suitably connected into the control circuit for sequenced operation.

A cam means 50 engages the longer leg 36 at a cam follower 52 on its end to provide measured rotational movement of said clamp 32 and said power nut 24. Upon movement of the cam means or cam plate 50 transversely to the leg 36, the cam follower 52 is moved. The cam follower 52 is preferably a roller. Drive solenoid 54, mounted to the inside of housing 12 permits only vertical motion of cam plate 50 as seen in the drawings. The cam follower 52 is biased by leaf springs 56 and 58.

Cam plate 50 is shown to have an internally cut out or internal cam surface defining opening 60 with cam surface portions 62 and 64.

As cam plate 50 moves transversely to the clamping legs 34 and 36 the cam follower portion 52 moves along a portion 62 of cam surface 60 for one distance "X" rotationally. "X" may be equivalent to 1 micron of linear motion produced in spindle 20, through nut 24 by one-half of a stroke of cam plate 50. The plate 50 may be provided with roller bearings 66 for low friction for this purpose.

During operation, the clamp is tightened on nut 24 by solenoid 48 to provide positive linear motion in spindle 20 corresponding to movement of the lever, i.e., leg 36, clockwise or counterclockwise in response to transverse translation of cam plate 50 as driven by solenoid 54 through the control circuit. The cam plate 50 pushes against roller 52 by means of cam surface 60.

Figure 9:
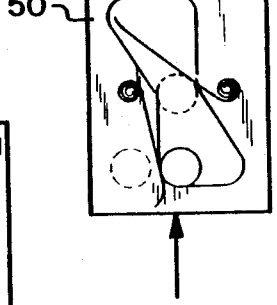
FIGS. 6–12 are schematic views similar to FIG. 5 with the cam plate at different positions at different times in the stroke and cycle.
Figure 8:
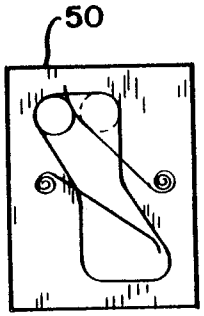
Figure 7:
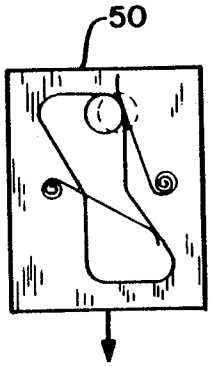
Figure 6:
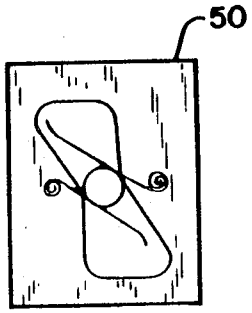

The high resolution, low speed mode causes the cam plate 50, cam surface portion 62, to drive the lever 36 through an angle sufficient to cause 1 micron of movement, for example. Specifically, the process is as follows: the clamp 40 locks; the drive solenoid 54 starts in the position of FIG. 6 and is energized in the direction desired, for example down (FIGS. 7 and 8); the clamp 40 unlocks; the solenoid 54 is spring returned to the center position (FIG. 9); the cycle repeats itself. This yields 1 micron of spindle movement.

Figure 5:
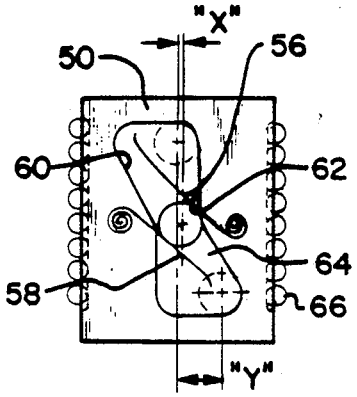
FIG. 5 is a schematic front view of the rotationally driving two-speed roller bearing mounted cam plate showing the cam follower and biasing spring positions of ½ stroke drive for 1 micron of spindle movement and for full stroke drive for 16 microns of movement upon solenoid powered movement of the cam plate transverse to the legs.
Figure 12:
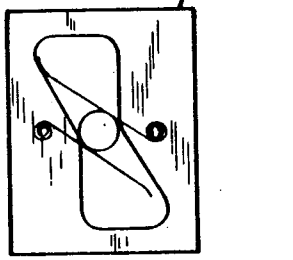
Figure 11:
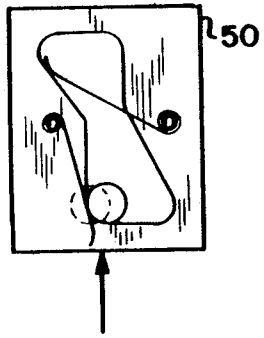
Figure 10:
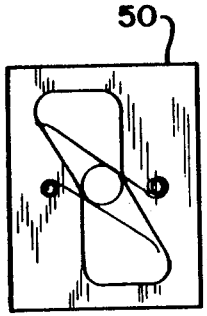
Figure 13:
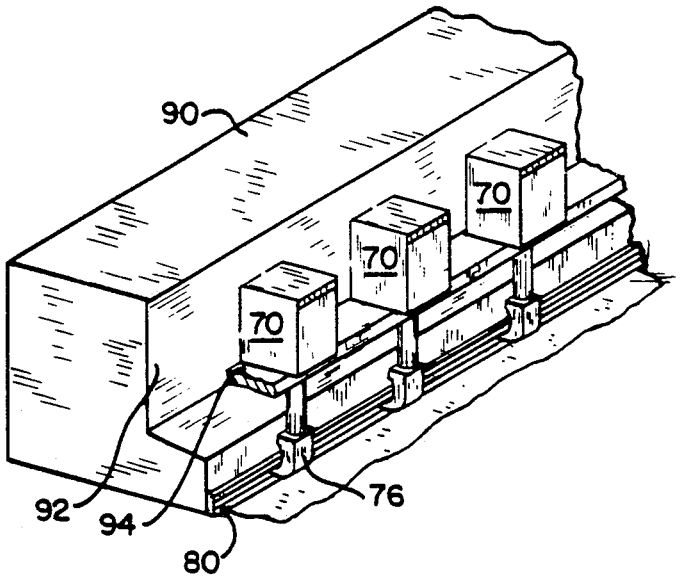
FIG. 13 is a fragmentary and schematic perspective view of a headbox with a slice lip metering the stock therefrom.
Figure 14:
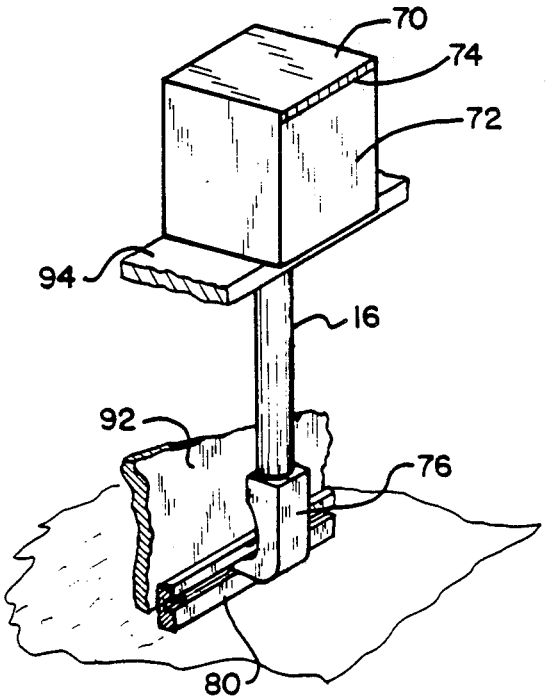
FIG. 14 is a detailed view of a portion of FIG. 13 showing one actuator and spindle position on the paper machine.

The high speed mode is desirable for high speed movement of the spindle and utilizes an additional step as follows: the lever clamp 32 is unlocked (FIG. 10): the drive solenoid 54 is energized in the opposite direction to the movement desired, i.e., up (FIG. 11); the clamp 32 locks; the drive solenoid 54 is energized by reversing polarity, pulling cam plate 50 down (FIG. 12); cycle repeats. This gives, for example, 16 microns per cycle. The spring 58 pushes the lever roller 52 to the "high speed set position", before the clamp 32 locks on nut 24 (FIG. 5) and begins upward travel along cam surface portion 64.

The two speed actuator combination 10 may be mounted within a housing 70 having a front door 72 with a top hinge 74 to protect the unit from the harsh paper machine environment. A hook 76 or other mechanical fastening means engages the slice lip 80 and moves that segmental portion of its length vertically. The stock containing headbox 90 has a front wall 92 from which extends the base plate 94. The base plate contains threaded openings within the housings 70 in which the threads 14 are received and through which spindle 16 extends. The slice lip 80 is thus adjusted across the machine at, typically, 60 locations, by means of a control circuit which meters stock from behind front wall 92 of the headbox 90 onto the fourdrinier wire of the paper machine.

The unit 10 may be made small enough to be installed for use with any headbox. See the one illustrated, for example, in U.S. Pat. No. 4,526,654. The unit provides high resolution capability, without sacrificing high speed because of its two speed modes. The device is of low cost and retains the commercial advantage of being both a "stepper" and "linear" that has been available in the prior art from the same assignee as this invention is assigned to. Moreover, the two speed, two resolution modes can be run through the control circuit selectively with software control. The changing resolution for custom designs is also simple and easy by merely changing the cam plate 50.

I claim:

1. A stepper acuator for rotationally driving a member about an axis of rotation, said actuator comprising in combination:

a clamp in engagement with said member to be rotationally driven;

said clamp including opposed clamping legs in spaced, substantially parallel relation:

said legs extending transversely to said axis of rotation;

means for moving said legs toward each other to clamp said member to be rotationally driven; and cam means engaging one of said legs to provide measured rotational movement of said clamp and said member to be rotationally driven, upon movement of said cam means when said member is clamped said cam means being structured and arranged to provide for the member to be driven at at least two different speeds.

2. The actuator of claim 1 in which the member to be rotationally driven is in combination with said actuator and is a power nut attached to a spindle clamp to linearly drive a spindle.

3. The actuator of claim 2 in which the linearly driven spindle is attached to a fluid metering means.

4. The actuator of claim 3 in which the fluid metering means is a slice lip.

5. The actuator of claim 1 in which the clamping legs are of different length and the cam means engages the longer of the two legs.

6. The actuator of claim 1 in which the means for moving the legs toward each other includes a cam surface which moves the legs toward each other as it moves transverse to the legs until the clamp is locked with said member to be rotationally driven locked to said clamp.

7. The actuator of claim 6 in which the means for moving the legs toward each other is a locking cam member with a cam surface portion for engaging each leg and said portions converge.

8. The actuator of claim 1 in which the cam means to provide measured rotational movement engages one of the clamping legs and that leg is longer than the other and includes a cam follower portion.

9. The actuator of claim 8 in which the cam means is a cam plate which moves transverse to the longer clamping leg and the follower moves along a cam surface defining opening in the cam plate during the cam plate transverse motion.

10. The actuator of claim 1 in which the cam means is a cam plate which moves transverse to the clamping legs and one of the clamping legs has a cam follower portion, the cam plate having a cam surface defining opening along which the cam follower moves during transverse movement of the cam plate, the opening having a portion of the cam surface for movement of the follower one distance when the cam plate moves a portion of the distance of its transverse motion and a different portion of the cam surface for movement of the follower a different distance when the cam plate moves a different portion of the distance of its transverse motion, thereby providing different rotation amounts and speeds to the member to be rotationally driven, upon movement of the cam means different transverse distances when said member to be rotationally driven is clamped.

11. The actuator of claim 10 in which the cam follower is spring biased to a neutral position between the different cam surface portions.

12. The actuator of claim 1 in which the cam means includes antifriction means.

13. The actuator of claim 1 in which the means for moving said legs toward each other include antifriction means.

* * * * *